US005426403A

United States Patent [19]

LaLau et al.

[11] Patent Number: 5,426,403

[45] Date of Patent: Jun. 20, 1995

[54] PRINTED CIRCUIT BOARD TRANSMISSION LINE COMPONENT

[75] Inventors: Richard LaLau; Steven M. Rae, both of North Vancouver, Canada; Henry F. Liebman, Tamarac, Fla.

[73] Assignee: Motorola, Inc., Schaumburg, Ill.

[21] Appl. No.: 176,809

[22] Filed: Jan. 3, 1994

[51] Int. Cl.[6] ..... H01P 3/08

[52] U.S. Cl. ..... 333/238; 333/243

[58] Field of Search ..... 333/238, 246, 243

[56] References Cited

U.S. PATENT DOCUMENTS

| | | | |
|---|---|---|---|
| 2,231,602 | 2/1941 | Southworth | 333/27 X |
| 2,721,312 | 10/1955 | Grieg et al. | 333/238 |
| 4,673,904 | 6/1987 | Landis | 333/238 |
| 5,068,632 | 11/1991 | Champeau | 333/238 |
| 5,164,692 | 11/1992 | Gertel et al. | 333/238 |

*Primary Examiner*—Paul Gensler

*Attorney, Agent, or Firm*—Charles W. Bethards

[57] ABSTRACT

A strip line component suitable for transporting radio frequency signals from point to point in an electronic assembly, including a first conductive element (13) having a first and a second termination contact (23 and 33), disposed in a planar fashion with a first or length dimension (15) and a second or width dimension (27), a dielectric material (17) suitable as a printed circuit board substrate and having a first planar surface (19), disposed around the first conductive element along the length dimension, where the first termination contact is preferably disposed on the first planar surface, and a second conductive element (21) having a plurality of contacts some of which are preferably on the first planar surface, disposed adjacent to and enclosing the dielectric material along the length dimension and spaced from the first conductive element by a third or height dimension (29) that is perpendicular to the width dimension.

15 Claims, 1 Drawing Sheet

FIG.1
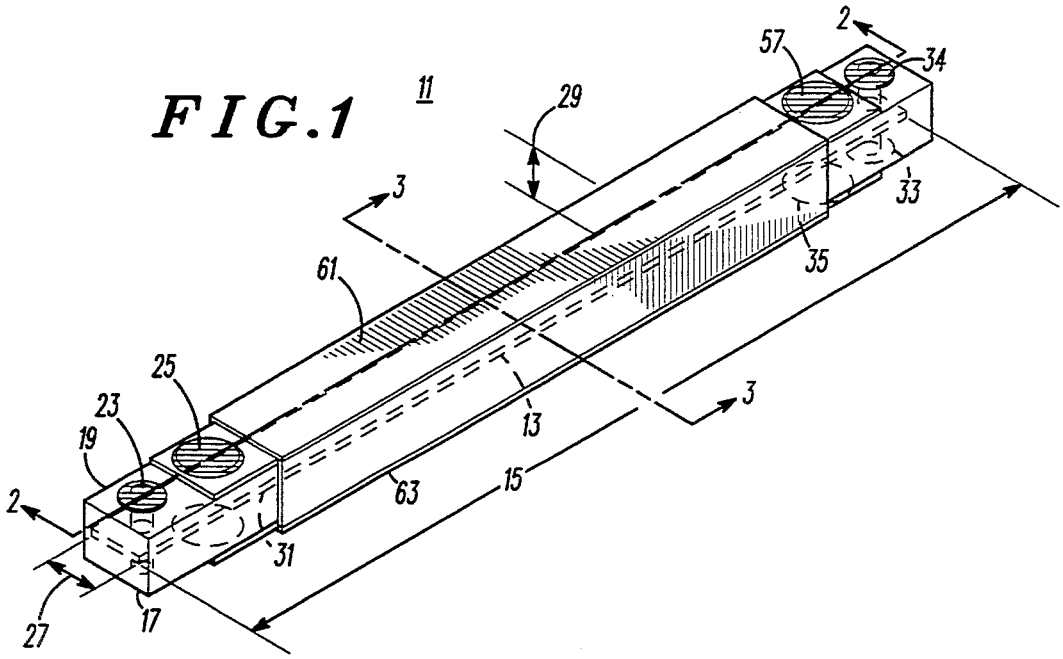
FIG.2
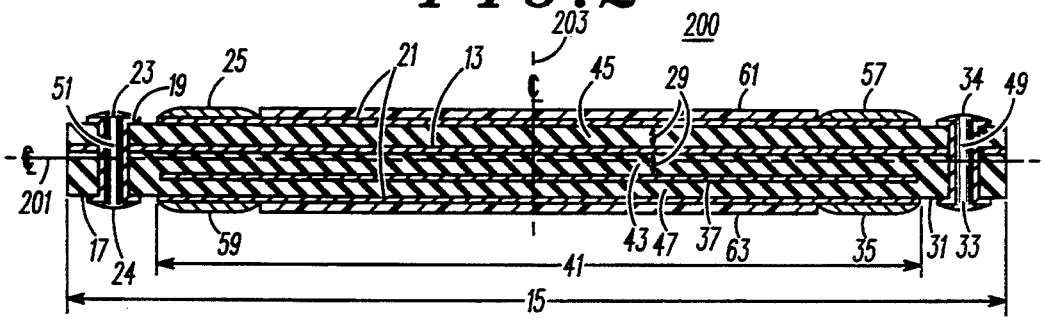
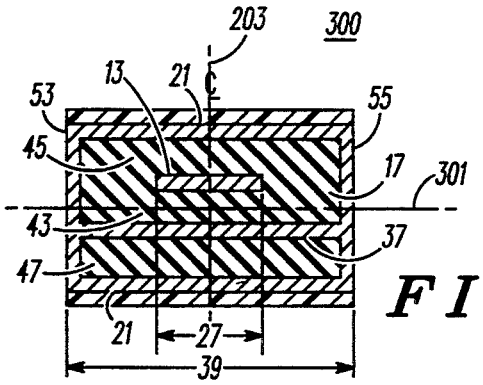
FIG.3

PRINTED CIRCUIT BOARD TRANSMISSION LINE COMPONENT

FIELD OF THE INVENTION

This invention deals generally with components suitable for electronic assemblies and more particularly with such a transmission line component.

BACKGROUND OF THE INVENTION

Generally components in an electronic assembly are used to perform some operation on or processing of an electrical signal. This processing may include simply transporting electrical signals from their respective sources to their intended destinations. Depending on the characteristics of the signals to be transported this may be a comparatively straightforward undertaking, in for example the case where the signal is a zero or low frequency signal or it may be significantly more difficult, where for example the signal is a high frequency or radio frequency signal.

In the latter case, the electromagnetic propagation properties of the high frequency signals results in significant obstacles to the efficient and uncorrupted transport of the electrical energy represented by such signals. Such a high frequency signal is not readily constrained to an intended path. If the high frequency signal has a very low power or energy level it can be subject to interference from other signals or alternatively if the high frequency signal has a relatively high power or energy level it may interfere with other signals. Practitioners have developed various structures to deal with the aforementioned problems.

These structures are variously known as transmission lines or coaxial transmission lines or strip lines depending on the specific characteristics or configuration of the structure and most serve to one extent or another to facilitate the efficient and uncorrupted transport of the electrical energy represented by such high frequency signals. The coaxial transmission line is a particularly advantageous configuration for efficiently transporting high frequency energy and providing excellent isolation between the desired signal and other signals, thus avoiding the problems of corruption. The coaxial transmission line configuration when used in electronic assemblies often takes the form of a semi-rigid coaxial cable with a round cross section.

While working well for uncorrupted signal transport, the round semi-rigid coaxial configuration presents a number of difficulties that must be dealt with by the manufacturing process that produces electronic assemblies. Dealing with these difficulties places an economic burden on the manufacturing process that uses such semi-rigid coaxial cables. To begin with the semi-rigid coaxial cables are relatively expensive. In addition they are made from a different material than the typical printed circuit board substrate often used to carry the components in a given electronic assembly. This mismatch in materials may contribute to different thermal characteristics such as expansion or contraction over temperature and hence additional precautions to avoid damage that may result from the mismatch or alternatively a lower quality electronic assembly. Furthermore the round cross section of the semi-rigid coaxial cable is difficult to work with in automated assembly processes. This cross section does not lend itself to automated pick and place operations.

Clearly a need exists for a reliable and inexpensive transmission line component that is readily adaptable to state of the art electronic assembly manufacturing processes.

BRIEF DESCRIPTION OF THE DRAWINGS

The features of the present invention that are believed to be novel are set forth with particularity in the appended claims. The invention, itself, however together with further advantages thereof, may best be understood by reference to the accompanying drawings in which:

FIG. 1 is a perspective view of a transmission line component constructed in accordance with one embodiment of the present invention.

FIG. 2 is a first cross sectional view of the FIG. 1 component.

FIG. 3 is a second cross sectional view of the FIG. 1 component.

DETAILED DESCRIPTION OF A PREFERRED EMBODIMENT

Generally the instant invention deals with a novel apparatus for advantageously conducting or transporting electrical energy, typically at radio frequencies and very low levels, from one or more points or sources to one or more points, loads, or destinations. This apparatus may be characterized as a transmission line component or more specifically a strip line component. The transmission line component is particularly suited as a component for electronic assemblies. The transmission line component includes a first conductive element, such as a copper or other metallic strip or layer, that has a first dimension, such as a length dimension. In addition a dielectric material suitable for a printed circuit board substrate, such as a glass epoxy composite material, is disposed around the first conductive element at least along the first dimension such that the dielectric material has at least a first planar surface. To complete the transmission line component a second conductive element is disposed adjacent to and around the dielectric material along the first dimension so as to be spaced from the first conductive element by, for example the thickness of the dielectric material. In sum a preferred embodiment of the instant invention may be constructed using multi-layer printed circuit board technology. Using this technology and as depicted in FIG. 1, an inner layer is the first conductive element or signal carrying conductor and the outer layers, coupled together using edge plating techniques, becomes the second conductive element, preferably the reference or ground conductor.

With that overview, the instant invention can be more fully described and appreciated with reference to the figures. FIG. 1 illustrates, in perspective, a strip line or transmission line component (11) that includes a first conductive element (13), disposed in a planar fashion along a first or length dimension (15), a dielectric material (17) disposed around the first conductive element (13), and a second conductive element (21) disposed around the dielectric material (17). The strip line component (11) may be readily constructed using ordinary printed circuit board fabrication procedures and processes. Although the embodiment depicted is suitable as a component in an electronic assembly that couples one point to another point via a straight line it will be obvious to those skilled in the art that the device may be configured in more complex arrangements, such as an "L" or "Z" shaped configuration. FIG. 1 further depicts a first cross sectional detail (2) and a second cross sectional detail (3). These cross sectional details are, respectively, shown in FIG. 2 and FIG. 3 wherein like elements are designated by like reference numerals.

The first conductive element (13) is one of two inner metal layers of a multi-layer printed circuit board structure in the preferred embodiment. The first conductive element (13) has a first dimension (15) or length dimension and a second dimension (27) or width dimension that is perpendicular to the first dimension. The first conductive element (13) is formed as a planar structure from 2 ounce copper, the first dimension (15), while not critical is approximately 2000 mil, and the second or width dimension (27) is approximately 11 mils. The second inner metal layer (37), not shown in FIG. 1 but depicted in FIG. 2 and FIG. 3, is connected to the second conductive element (21) and thus acts as part of the second conductive element (21). The inner metal layer (37) has a length dimension (41) that is slightly less than the first dimension (15) and a width dimension (39) that is approximately 70 mils. In practice the first conductive element (13) and the inner metal layer (37) are conductive patterns disposed on opposite sides of a dielectric layer (43) that is part of the dielectric material (17). This dielectric layer (43) is printed circuit board substrate material, such as glass epoxy, and is approximately 20 mils thick.

The dielectric material (17) includes the dielectric layer (43) together with dielectric layers (45 and 47). The dielectric layers (45 and 47) are each glass epoxy layers like dielectric layer (43) and have each been laminated to dielectric layer (43) to form the dielectric material (17) having a first planar surface (19) and a second planar surface (31). The dielectric material (17) thus surrounds or is disposed around the first conductive element (13) along the first dimension (15). Through holes (49 and 51) have been drilled perpendicular to the first and the second planar surfaces (19 and 31) so as to pass through the first conductive element (13). The through holes (49 and 51) are plated with copper and subsequently filled with solder, thus providing an electrical connection to the first conductive element (13). The through holes are further connected at either end to termination contacts. Specifically the through hole (51) is connected to a first termination contact (23) that is preferably disposed on the first planar surface (19) and an additional termination contact (24) that is preferably disposed on the second planar surface (31). Similarly, the through hole (49) is connected to a termination contact (34) that is preferably disposed on the first planar surface (19) and a third termination contact (33) that is preferably disposed on the second planar surface (31). A signal may be coupled from a source to the first conductive element (13) and coupled from the first conductive element (13) to a load utilizing these termination contacts.

The second conductive element (21) is disposed adjacent to and around or so as to substantially encompass the dielectric material (17) along the first dimension (15). The second conductive element (21) is spaced away from the first conductive element (13) by a third dimension (29) that is perpendicular to the first and the second dimensions (15 and 27). In the preferred embodiment the third dimension (29) is approximately 20 mils and is controlled by or equivalent to the thickness of the dielectric layers (45 and 47). The second conductive element (21) includes, functionally, the inner metal layer (37) and a conductive layer, such as copper, that is preferably disposed on the first planar surface (19) or the outer surface of dielectric layer (45). To preserve symmetry of the transmission line component and take full advantage of the multi layer printed circuit board technology the second conductive element (21) may further include a conductive layer, such as copper, that is disposed on the second planar surface or outer surface of dielectric layer (47). In any event all conductive layers including the inner metal layer (37) are connected together at each edge by edge layers (53 and 55) that are formed by a procedure known as edge plating as is well known in the printed circuit board industry.

Additionally the second conductive element (21) has a plurality of termination contacts a portion of which are disposed on the first planar surface (19) and a portion of which are disposed on the second planar surface (31). The plurality of termination contacts includes a second termination contact (25) and a fifth termination contact (57) disposed on the first planar surface (19) and a fourth termination contact (35) and a sixth termination contact (59) disposed on the second planar surface (31). One or more of these termination contacts may be advantageously utilized to connect the second conductive element to a reference potential, preferably, a reference potential or a circuit ground in an electronic assembly. Finally a coating of solder resist (61 and 63) has been applied to cover the majority of the second conductive element, as depicted in the FIGs. In practice this solder resist will cover the first and the second planar surfaces with the exception of the termination contacts for the first and the second conductive elements.

In the above description of a preferred embodiment of the instant invention the second dimension (27) has been pre-selected and specified as 11 mils and the third dimension (29) was similarly pre-selected and specified as 20 mils. Additionally the first conductive element (13) was formed using 2 ounce copper. These values were selected such that the transmission line component would present an approximate 50 ohm input impedance when it was driving a 50 ohm load. While 50 ohms was used and was convenient for the preferred embodiment those skilled in the art will recognize that this impedance can be varied by adjusting the second and the third dimensions for a given weight or thickness of the copper forming the first conductive element (13). In addition again as is known in the art, by varying the geometry of the first conductive element (13) from the simple rectangular shape used in the preferred embodiment or if need be the third dimension (29) an impedance transformation, for example 50 ohms at some angle to 300 ohms at a different angle, may be accomplished or provided for using the principles and basic characteristics of the instant invention.

The width dimension (39) of the inner metal layer (37) is also the overall width dimension of the transmission line component. This dimension at 70 mils is sufficient when compared to the 11 mil second dimension (27) to provide little if any effect on the input impedance as a result of the interaction between the first conductive element (13) and the edge layers (53 and 55). Thus the instant invention may provide efficient and uncorrupted transport of the energy represented by a high frequency signal without causing interference with other signals.

One further feature of the preferred embodiment is the functional symmetry of the transmission line component (11). Functional symmetry is defined as the property that the transmission line component will be mechanically and electrically identical and operational, i.e. functionally equivalent, if the transmission line component is rotated through an angle of 180 degrees about an axis lying in a plane that is perpendicular to the first planar surface (19). The preferred embodiment includes at least two such planes. One plane includes center lines (201 and 203) and the second plane includes center lines (203 and 301). In sum the preferred embodiment may be rotated 180 degrees about any one or more of at least the three center lines (201, 203, or 302) and retain full functionality. This feature is particularly advantageous in automated assembly operations as the assembly equipment need not worry about proper component orientation to the same extent. The planar surfaces also are advantageous due to their inherent stability as compared to the round cross sections typically encountered with solid or semi-rigid coaxial cables. Since the transmission line component (11) is constructed from printed circuit board substrate material the possibility of thermal expansion mismatch with the electronic assembly and its printed circuit board has been eliminated.

It will be appreciated by those of ordinary skill in the art that the apparatus disclosed provides a transmission line component that is particularly well suited for automated assembly and yet provides all the attributes ordinarily associated with a strip line component or conductor while eliminating the detrimental effects associated with prior art strip line components in an economically effective manner. Thus, the present invention satisfies a long-felt need for such a transmission line component.

It will be apparent to those skilled in the art that the disclosed invention may be modified in numerous ways and may assume many embodiments, such as a more complex "L" or "Z" pattern, other than the preferred form specifically set out and described above. Accordingly, it is intended by the appended claims to cover all modifications of the invention which fall within the true spirit and scope of the invention.

What is claimed is:

1. A transmission line component suitable as a component in an electronic assembly, comprising:

a first conductive element having a first dimension and a first termination contact, a dielectric material suitable as a printed circuit board substrate and having a first planar surface, said dielectric material disposed around said first conductive element along said first dimension, and a second conductive element including a second termination contact disposed adjacent to and around said dielectric material along said first dimension and spaced from said first conductive element.

2. The transmission line component of claim 1 wherein said first conductive element includes a second dimension that is perpendicular to said first dimension and said second conductive element is uniformly spaced from said first conductive element at a third dimension that is perpendicular to said first and said second dimensions.

3. The transmission line component of claim 2 wherein said second and said third dimension are preselected to provide a desired input impedance at said first termination contact.

4. The transmission line component of claim 1 wherein said transmission line component is functionally symmetrical about an axis lying within a plane that is perpendicular to said first planar surface.

5. The transmission line component of claim 4 wherein said first conductive element includes a second dimension that is perpendicular to said first dimension and said second conductive element is uniformly spaced from said first conductive element at a third dimension that is perpendicular to said first and said second dimensions.

6. The transmission line component of claim 5 wherein said second and said third dimension are preselected to provide a desired input impedance at said first termination contact.

7. The transmission line component of claim 6 wherein said first termination contact is disposed on said first planar surface.

8. The transmission line component of claim 1 wherein said dielectric material includes a second planar surface.

9. The transmission line component of claim 8 wherein said first conductive element includes a second dimension that is perpendicular to said first dimension and said second conductive element is uniformly spaced from said first conductive element at a third dimension that is perpendicular to said first and said second dimensions.

10. The transmission line component of claim 9 wherein said second and said third dimension are preselected to provide a desired input impedance at said first termination contact.

11. The transmission line component of claim 8 wherein said transmission line component is functionally symmetrical about an axis lying within a plane that is perpendicular to said first planar surface.

12. The transmission line component of claim 11 wherein said first conductive element includes a second dimension that is perpendicular to said first dimension and said second conductive element is uniformly spaced from said first conductive element at a third dimension that is perpendicular to said first and said second dimensions.

13. The transmission line component of claim 12 wherein said second and said third dimension are preselected to provide a desired input impedance at said first termination contact.

14. The transmission line component of claim 13 wherein said first conductive element includes a third termination contact and said second conductive element includes a fourth termination contact, said first termination contact and said second termination contact disposed on said first planar surface and said third termination contact and said fourth termination contact disposed on said second planar surface.

15. A strip line component suitable for transporting radio frequency signals from point to point in an electronic assembly, said strip line component comprising:

a first conductive element having a first and a second termination contact, said first conductive element disposed in a planar fashion with a length dimension and a width dimension, a dielectric material suitable as a printed circuit board substrate and having a first planar surface, said dielectric material disposed around said first conductive element along said length dimension, said first termination contact disposed on said first planar surface; and a second conductive element having a plurality of contacts, said second conductive element disposed adjacent to and enclosing said dielectric material along said length dimension, said second conductive element spaced from said first conductive element by a height dimension that is perpendicular to said width dimension, a portion of said plurality of contacts disposed on said first planar surface.

* * * * *